US006016753A

United States Patent [19]

Glenn et al.

[11] Patent Number: 6,016,753

[45] Date of Patent: Jan. 25, 2000

[54] EXPLOSIVE PIPE CUTTING

[75] Inventors: Joseph G. Glenn; Gary H. Parsons, both of Niceville; Michael E. Gunger, Valparaiso; John J. Osborn, Niceville, all of Fla.

[73] Assignee: The United States of America as represented by the Secretary of the Air Force, Washington, D.C.

[21] Appl. No.: 09/141,382

[22] Filed: Aug. 27, 1998

Related U.S. Application Data

[63] Continuation-in-part of application No. 08/896,376, Jul. 18, 1997, abandoned, which is a continuation-in-part of application No. 08/583,887, Jan. 11, 1996, Pat. No. 5,698,814, which is a continuation-in-part of application No. 08/409,559, Mar. 10, 1995, abandoned.

[51] Int. Cl.[7] ..... F42B 1/02

[52] U.S. Cl. ..... 102/307; 102/309; 102/476

[58] Field of Search ..... 102/307, 309, 102/476

[56] References Cited

U.S. PATENT DOCUMENTS

| | | | |
|---|---|---|---|
| H344 | 10/1987 | Williamsen | 102/476 |
| 905,042 | 11/1908 | Wratzke | 102/502 |
| 1,146,484 | 7/1915 | Dunwoody | 102/24 |
| 2,587,243 | 2/1952 | Sweetman | 102/313 |
| 2,587,244 | 2/1952 | Sweetman | 11/11 |
| 2,761,384 | 9/1956 | Sweetman | 102/310 |
| 2,837,027 | 6/1958 | Martin | 102/307 |
| 3,053,182 | 9/1962 | Christopher | 102/307 |
| 3,057,295 | 10/1962 | Christopher | 102/307 |
| 3,108,540 | 10/1963 | Fletcher | 102/49 |
| 3,233,688 | 2/1966 | Bell | 102/307 |
| 3,244,104 | 4/1966 | Mills et al. | 102/49 |
| 3,245,485 | 4/1966 | Bell | 175/4.6 |
| 4,354,433 | 10/1982 | Owen | 102/307 |
| 4,493,260 | 1/1985 | Foster | 102/307 |
| 4,638,130 | 1/1987 | Grössler et al. | 200/61.45 R |
| 4,649,824 | 3/1987 | Guay | 102/307 |
| 5,010,823 | 4/1991 | Morrison | 102/307 |
| 5,046,563 | 9/1991 | Engel et al. | 166/297 |
| 5,129,322 | 7/1992 | Christopher et al. | 102/202.3 |
| 5,255,608 | 10/1993 | Min et al. | 102/215 |
| 5,698,814 | 12/1997 | Parsons et al. | 102/478 |

FOREIGN PATENT DOCUMENTS

| | | |
|---|---|---|
| 34 08 113 C1 | 5/1985 | Germany . |
| 39 34 041 A1 | 5/1993 | Germany . |

*Primary Examiner*—Peter A. Nelson

*Attorney, Agent, or Firm*—Gerald B. Hollins; Thomas L. Kundert

[57] ABSTRACT

An explosive material-energized plasticized metal slug cutter for use within tubular cylinders, or pipe or similar structures-especially in buried or otherwise inaccessible locations is disclosed. The cutter includes explosive material initially disposed in a particular hourglass or dogbone shape and surrounded by a layer of explosive-plasticizable copper or similar material which becomes both heated to plasticity and imparted with kinetic energy upon explosive material detonation. The hourglass or dogbone shape of the explosive material provides focus or shaping of the copper metal into a confined slug pattern enabling a clean and relatively low expended-energy cutting of a surrounding tubular cylinder into axial segments. The cutter employs a cutting action inclusive of spalling at the outer surface of the cut tubing opposite the region of slug impact. Scaling of explosive material sizes, weights and shapes for differing tubular cylinder dimensions is disclosed along with a mathematical algorithm usable in cutting action prediction.

31 Claims, 5 Drawing Sheets

EXPLOSIVE PIPE CUTTING

CROSS-REFERENCE TO RELATED APPLICATIONS

This application is a Continuation In Part of application Ser. No. 08/896,376 filed Jul. 18 1997 and now abandoned; the Ser. No. 08/896,376 application is in turn a Continuation In Part of application Ser. No. 08/583,887 now U.S. Pat. No. 5,698,814 filed Jan. 11, 1996; the 08/583,887, U.S. 5,698, 814, application is in turn a Continuation In Part of application Ser. No. 08/409,559 filed Mar. 10, 1995 and now abandoned. These applications are all assigned to the Government of the United States as represented by the Secretary of the Air Force. To whatever extent it may be appropriate the disclosure of these previous applications is hereby incorporated by reference herein.

RIGHTS OF THE GOVERNMENT

The invention described herein may be manufactured and used by or for the Government of the United States for all governmental purposes without the payment of any royalty.

BACKGROUND OF THE INVENTION

The present invention relates to the segregation of a laterally closed elongated object such as a length of tubular material or pipe into axial segments using an internally-disposed explosive charge cutter of selected shape and a moving slug of detonation-plasticized metal in the cutting mechanism.

Explosion-based axial segregation of military munitions devices and objects such as threaded bolts is known in the mechanical arts. Examples of such devices are to be found in the layered target penetrator weapon of the above-identified issued-patent parent application of this document and in the explosive bolts now commonly used in space or military hardware and other performance-driven equipment. Each of these applications represents a utilization of apparatus which has become known in the art as explosively formed penetrator devices. Explosive energized cutting of steel objects including pipe has also been practiced using shaped explosive charges generally including a vee shaped cross sectional configuration at the charge periphery. The inventors of the present cutting arrangement have found it possible to significantly improve such previously used cutting devices—largely through providing a certain different initial shape for the explosive charge.

SUMMARY OF THE INVENTION

The present invention provides an improved explosive based cutter for pipe or pipe-like tubular materials. The cutter of the invention is particularly adapted to segregating buried or otherwise inaccessible specimens of such materials into axially-discrete segments. An improved hourglass or dogbone initial shape for the explosive charge contributes to the improved cutting action achieved.

It is an object of the present invention to provide a new explosively formed penetrator device.

It is another object of the present invention to provide an improved explosively formed penetrator in which the explosive material and its associated metal material are disposed in an advantageous particular initial shape.

It is another object of the present invention to provide an explosively formed penetrator device usable in inaccessible locations.

It is an object of the present invention to provide an improved explosive material-based elongated tube cutter arrangement.

It is another object of the present invention to provide an improved explosive material-based elongated tube cutter device using a slug of explosive energy-influenced metal as a portion of its cutting mechanism.

It is another object of the present invention to provide an improved explosive material-based elongated tube cutter employing a slug of explosive energy-plasticized and mechanically accelerated metal in its cutting mechanism.

It is another object of the present invention to provide an explosively formed penetrator in which certain dimensional and angular shape dispositions are used for the pre-detonated explosive charge.

It is another object of the present invention to provide an explosively formed penetrator device in which certain precise dimensional and angular explosive material relationships can be extended to cutters of differing size and explosive quantity content.

It is another object of the present invention to provide an explosively formed penetrator device performing a cleaner and lesser adjacent surface-damaged cutting of a pipe or elongated strand device.

It is another object of the present invention to provide an explosively formed penetrator usable under a variety of environmental conditions such as while immersed in high pressure, high temperature fluids.

It is another object of the present invention to provide an explosively formed penetrator usable under a variety of environmental conditions such as while immersed in fluids including petroleum products and water for examples.

It is another object of the present invention to provide an explosive charge-based cutter in which an optimum amount of metal such as copper is used to form the cutting slug.

It is another object of the present invention to provide an explosive charge-based cutter operating at the plasticized metal slug energy level; a level below that of a liquefied metal jet cutter.

It is another object of the present invention to provide an explosive charge-based cutter arrangement in which spalling action is used as part of the cutting mechanism.

It is another object of the present invention to provide an explosive charge-based cutter system in which the achieved cutting action is responsive to a relationship of densities between the cutting slug metal and the cut metal.

Additional objects and features of the invention will be understood from the following description and claims and the accompanying drawings.

These and other objects of the invention are achieved by the method for improving cutting performance of a vee shaped explosive charge energized plasticized metal cutter comprising the steps of:

adding to an amount of explosive and plasticizable metal materials available for cutting action in said vee shaped explosive charge cutter by altering a cross sectional shape characteristic of said vee shaped explosive charge;

said cross sectional shape characteristic altering including adding at an axial center portion of said vee shaped explosive charge, intermediate explosive detonation-plasticizable metal covered explosive charge vee-half portions, an axially extending central cylindrical explosive charge section of smaller diameter than a largest diameter of said explosive charge vee-half portions;

said added axially extending central cylindrical explosive charge section being received in an axially extending central cylindrical enclosure of explosive detonation-plasticizable metal;

detonating said explosive material commencing at a central point of said added axially extending central cylindrical explosive charge section said detonation propagating thence along said axially extending central cylindrical section into said explosive charge vee-half portions.

DETAILED DESCRIPTION

Figure 3:
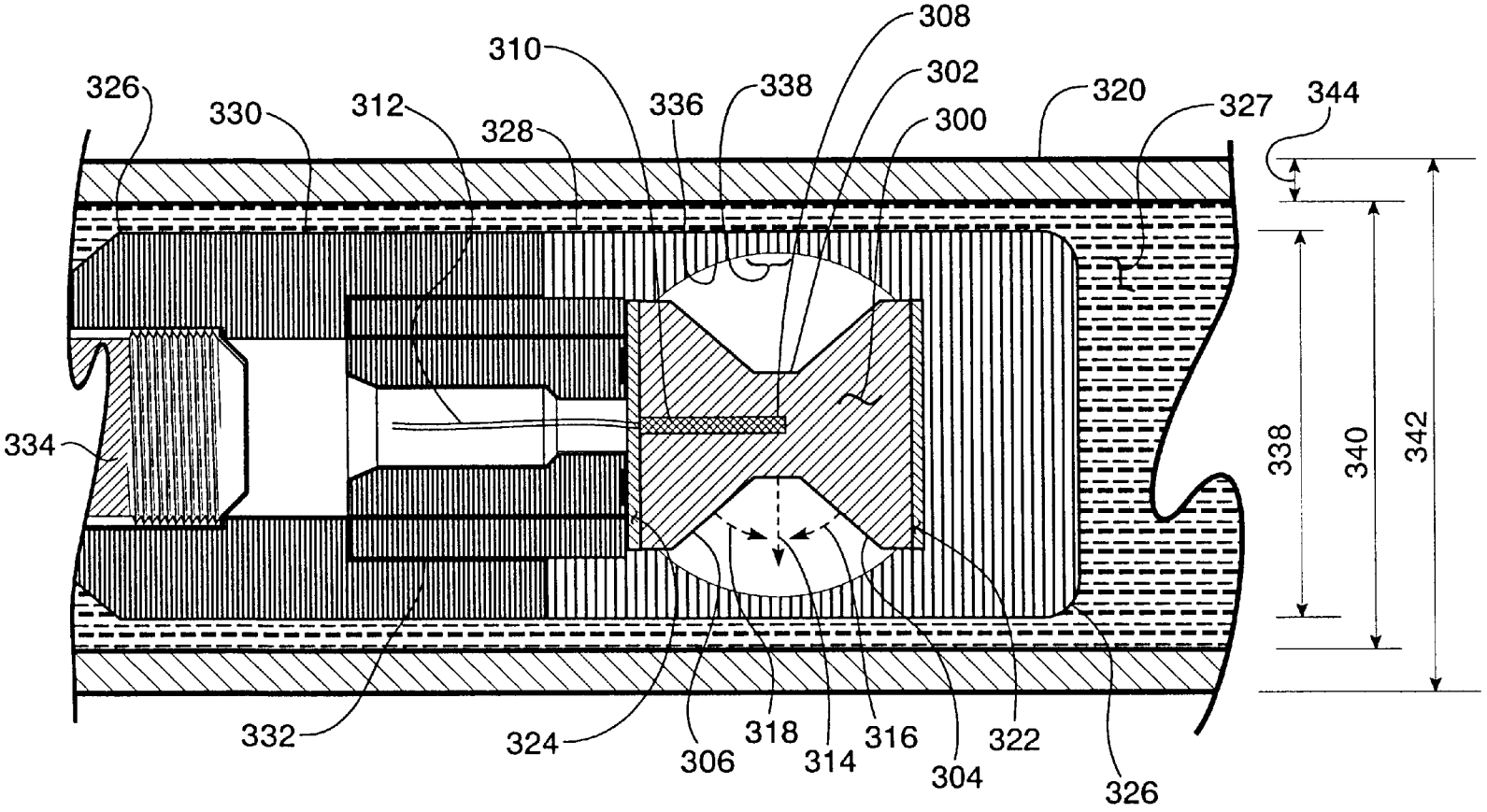
FIG. 3 shows a sectional view of a plasticized metal cutter according to the invention surrounded by typical field use apparatus.
Figure 6:
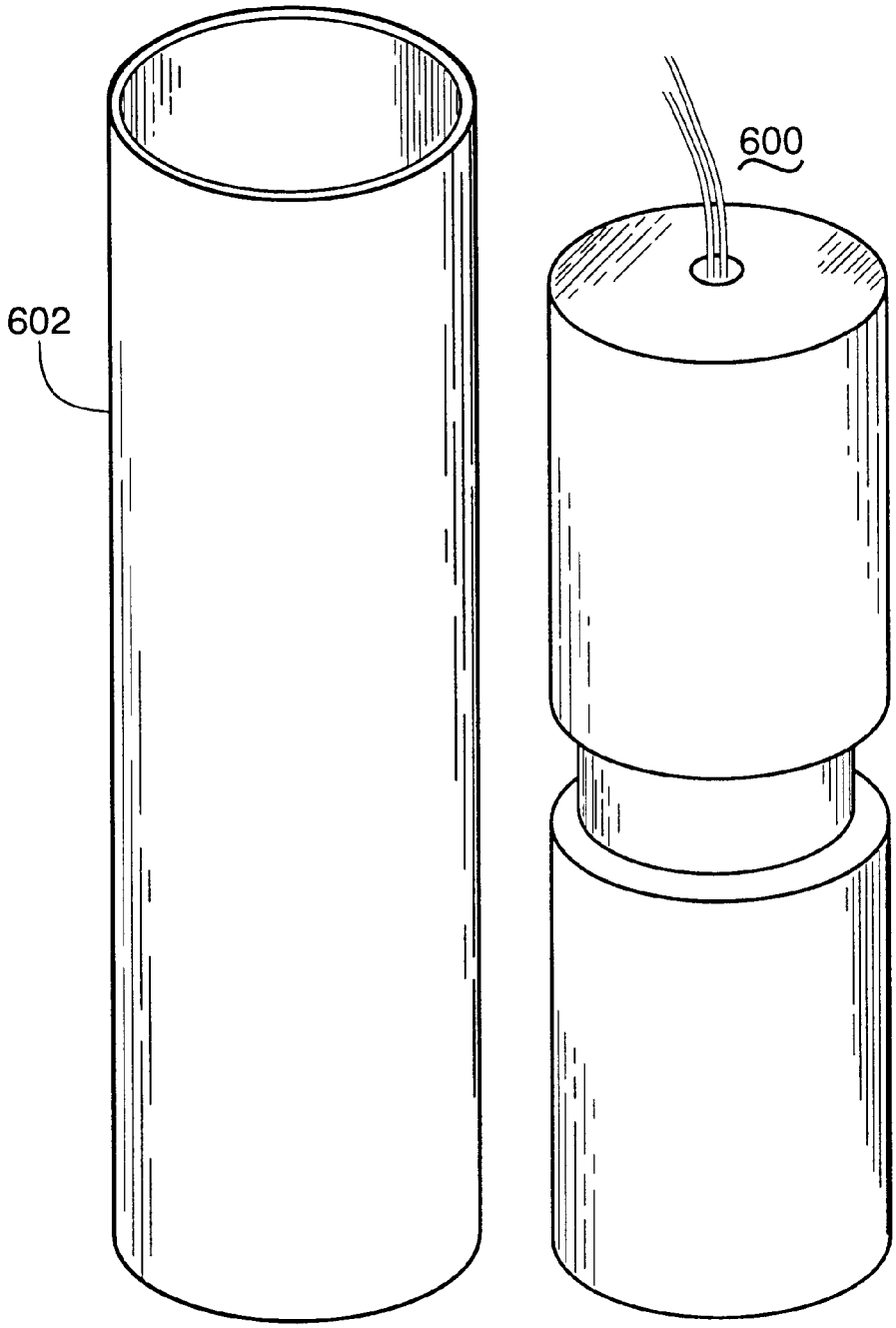
FIG. 6 shows the FIG. 5 cutter in closed surroundings condition and the test pipe into which the cutter is to be disposed.

It is often desirable in oil exploration and oil production to recover steel tubular material such as piping extending into the earth for the purpose of extracting oil from a subterranean pool. Such recovery is desirable for economic reasons in allowing reuse of the pipe, as well as for leaving an abandoned well in a secure, stable, environmentally safe and readily recoverable state. The standard piping in such oil well endeavors is often made of high strength steel, such as the types 4100 or 4340, providing pipe rated to withstand pressures of 105,000 pounds per square inch. The popular 2.88 inch outside diameter version of such pipe, includes a wall thickness of almost one quarter of an inch; FIG. 3 and FIG. 6 herein show additional details of such pipe. The recovery of several miles of such pipe from a well is often a worthwhile effort, particularly when the pipe is relatively new or environmental considerations are prevalent.

In many instances this recoverable pipe is received within a cemented-in-place well casing which is itself not considered a recoverable item and is therefore to remain in the ground. Such casing-enclosed recoverable piping is usually provided in sections with male and female threaded ends and is placed within a well in these discrete lengths—which are each threaded onto the preceding section at or near ground level and then lowered into the well casing. Pipe recovery can involve unthreading these male-female couplings as each is pulled from the well casing; however, release of the pipe near its lower extremity is often needed in order to commence this pulling. Use of section joint unthreading while in the ground is usually impractical for this release, since assurance of unthreading at a desired joint is not easily accomplished while the pipe is received within the well casing and the two pipe sections adjacent a joint are inaccessible.

The recovery of pipe is therefore often preceded by an underground pipe cutting operation in which release of the pipe at its lower extremity or some other desirable location is accomplished. To perform this pipe cutting it has been normal to use a cutter device of the explosive energized type, possibly a cutter of the type identified as a "vee shaped flexible linear shape charge cutter", the cutter being positioned in the pipe to be recovered by way of being fixed to a smaller pipe and lowered into the recoverable pipe to an appropriate detonation position. A cutter of this type is shown in FIG. 2 herein.

It may be appreciated, however, that a number of practical problems arise in performing this cutting operation. These problems can include, for example, the pipe to be cut being surrounded by and filled with fluids such as water and/or petroleum existing under conditions of relatively high pressure and temperature—conditions which the cutter device must withstand without damage prior to its activation. Temperatures of three hundred to four hundred degrees Fahrenheit and hydrostatic pressures of twenty thousand pounds per square inch are common in this environment for example. Another practical problem is concerned with the nature of the cut accomplished by an explosive energy cutter—if the cut pipe end is, for example, severely spalled, flared or otherwise changed in dimensions by expansion or by melted metal attachments, its extraction from the casing can be hindered or precluded. It is also desirable for the cutter to be as precisely controlled as possible in order that its cutting action be confined to the intended interior pipe and not extend to damaging the well casing for example. Nevertheless, it is desirable for a single cutter arrangement to be usable under both near ideal conditions (such as a dry pipe of near cutter diameter) and under more challenging conditions. It is necessary for a practical pipe cutter to provide assured cutting of the intended pipe throughout a three hundred sixty degree arc under these varying conditions.

Figure 2:
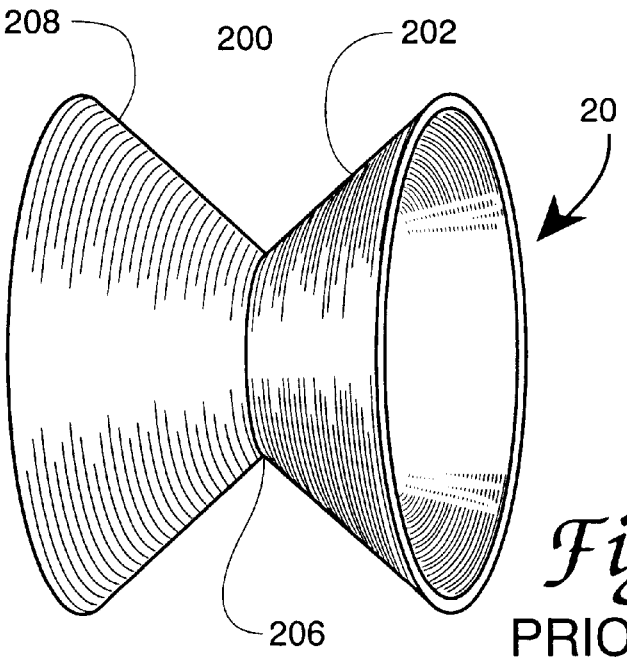
Fig. 2 PRIOR ART
FIG. 2 shows a three dimensional representation of the metallic enclosure element for a prior art explosive cutter.

The FIG. 2 drawing shows a three dimensional representation of an explosive material-surrounding metal jacket or cutter enclosure (i.e., the copper liner) 200 often used in the vee shaped flexible linear shape charge cutter presently employed for this type of pipe cutting. The FIG. 2 metal jacket or cutter enclosure 200 is usually fabricated from soft copper and may be described geometrically as two top-joined conical frustum sections, 202 and 208 mated at their common top surface 206. The conical frustum sections 202 and 208 in FIG. 2 are each preferably made to have open faces at their joined ends so explosive material can be loaded from a single large end of the metal enclosure. The FIG. 2 cutter enclosure may be fabricated in a variety of dimensions according to the pipe being cut. In this cutter, the hollow interior portion 204 when filled with a suitable explosive material is also provided with a centrally located detonator element. The entire FIG. 2 assembly is usually placed in a housing such as a shaped zirconia ceramic enclosure for insertion into the pipe to be cut.

Experience, however, has shown that this FIG. 2 cutter arrangement provides pipe-cutting action that is less than optimum for many encountered uses. In many instances, for example, it is found necessary to use power equipment to physically pull or "jerk" on a supposedly "cut" pipe in order to achieve its final and complete segregation. In short it is found that this FIG. 2 cutter simply does not cut well. The FIG. 2 cutter often also results in undesired pipe damage including spalling, cracking, cut end flaring and excessive cut edge roughness. It is also found that the quantity of explosive material needed to achieve cutting, especially under the above identified less than optimum conditions, is greater than desired with this FIG. 2 cutter arrangement and perhaps most important of all, that the jet metal quantity available for achieving the cut is less than optimum when it originates in a jacket or explosive liner of the FIG. 2 shape. Moreover, as a crude measure of comparison between the FIG. 2 cutter and the improved cutter of the present invention it may be of interest to note that when the present inventors first embarked upon the effort which led to the munitions cutter disclosed in the issued parent patent application of the present application, the FIG. 2 cutter arrangement was considered and tested for this munitions use. This configuration was, however, quicldy abandoned as providing such weak cutting action as to offer little promise of accomplishing the cutting task presented by a thick, gun-barrel-tube-derived, munitions projectile. The presently described cutter was in comparison found fully capable of meeting this challenge.

We have therefore found that the hourglass-shaped plasma jet cutter disclosed for munitions projectile segregation in the above identified Ser. No. 08/409,559 patent application and in U.S. Pat. No. 5,698,814, can also be used to significant advantage as a replacement for the FIG. 2 vee shaped flexible linear shape charge cutter in the pipe cutting and related environments. In particular we find modification of the vee shaped charge cutter to include an axis-located cylindrical center section is desirable for enhancement of the achieved cutting action. We also find that the additional metal mass and explosive relocation over that of the vee shaped flexible linear shape charge cutter are desirable. In fact the resulting generally hourglass or dogbone shaped explosive charge with its larger metal quantity enclosure results in a more efficient cutter which provides clean cutting of a pipe or similar structural shape with less explosive material than would be used in the comparable vee shaped flexible linear shape charge cutter of FIG. 2.

Figure 1:
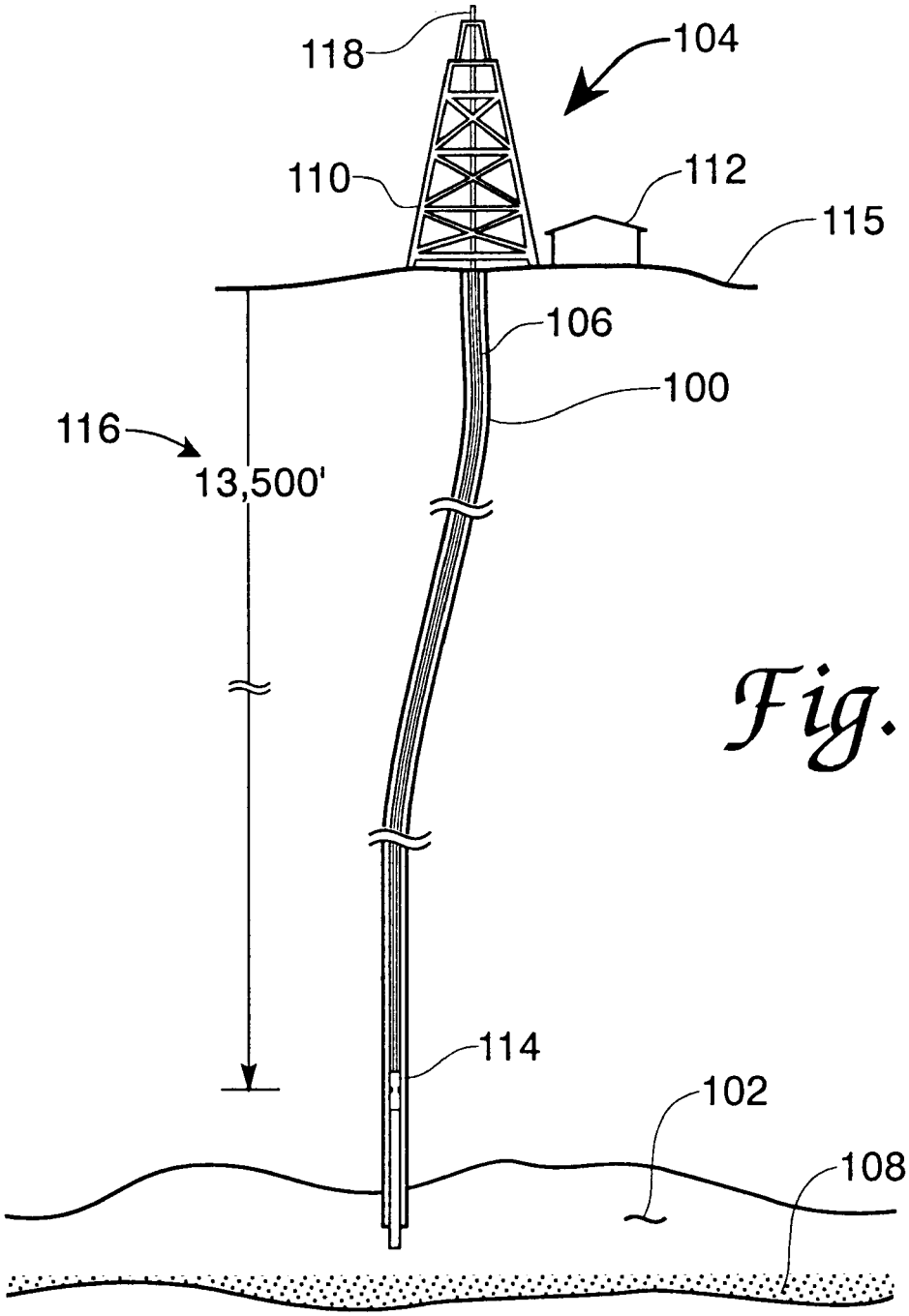
FIG. 1 shows an explosive cutter according to the invention in a typical use environment.

FIG. 1 in the drawings therefore shows a metal cutter 114, a cutter of the explosively formed penetrator type according to the present invention, disposed in a typical use environment. In FIG. 1 (which is not drawn to scale) a deep well casing 100 is shown disposed in a slightly radially offset alignment between a depleted underground pool region 102 and a surface wellhead apparatus 104. This wellhead apparatus is generally represented by the structural tower 110 and an engine driven lifting apparatus located in housing 112. Within the casing 100 is located a fluid conduit pipe 106 through which liquids and gas from the pool region 102 have been extracted until the remaining pool indicated at 108 is no longer economically viable for production; removal of the fluid conduit pipe 106 is therefore desired. As indicated at 116 the area of desired cutting of the fluid conduit pipe 106 may be located several thousand feet, 13,500 feet being shown, below the earth's surface 115. Although cutting of the fluid conduit pipe 106 is represented in FIG. 1, it is of course possible that the concepts of the invention can be extended to a cutting of the casing 100 itself or to other casing-received elements. The explosive cutter apparatus disposed within the casing 100 and within the fluid conduit pipe 106 is indicated at 114 in the FIG. 1 drawing and the smaller diameter pipe or rod which positions the cutter at the depth 116 is indicated at 118. Although the FIG. 1 environment represents a challenging use of the present invention cutter, the device is not limited to this usage and indeed may find application in cutting above ground-disposed pipe (and related materials such as square column stock for example) and may also be used to cut horizontally disposed or circularly oriented stock (within some reasonable curvature radius range). Use of the present invention cutter to cut bridge support, building column or other structural elements is also envisioned.

FIG. 3 in the drawings shows a cross sectional representation and more details of an explosive cutter device of the explosively formed penetrator type according to the present invention—as this cutter is typically arranged for in the field insertion into a deep well. Initially from the FIG. 3 drawing it is apparent that a significant aspect of the present invention cutter 300 is its inclusion of the new central cylindrical section 302 intermediate its conical frustum sections 304 and 306. In fact it is the addition of this central cylindrical section 302 (or possibly some functional equivalent thereof to the conventional vee shaped cutter which is believed to provide a significant contribution to the improved cutting action and greater efficiency afforded by the present invention cutter.

The central cylindrical section 302 of the FIG. 3 cutter can in fact be appreciated to provide several contributions to the improved cutting action of the present invention cutter; included in these contributions are believed to be the following:

1. Provision of an additional quantity of explosive material, i.e., the explosive material contained in the new cylindrical section; (the total quantity of explosive material used in a particular FIG. 3 cutter may nevertheless be smaller than that required for effective use cof a FIG. 2 cutter in view of the more effective use of this material in the FIG. 3 cutter);
2. Provision of this added explosive material in a particularly desirable functional location in the FIG. 3 cutter;
3. Provision of additional quantity of metal jacket material for formation of the cutting action metal slug, metal jacket material surrounding the new central cylindrical section; (this material too is provided at a particularly desirable location with respect to cutter; function);
4. Provision of new propagation time delay mechanism (of nanoseconds or microseconds duration) between detonation initiation and detonation commencement in the conical frustum main charge quantities 304 and 306; i.e., providing detonation propagation delay along the central cylindrical section of the FIG. 3 cutter;
5. Added initial metal slug formation interval during this new propagation time delay, i.e., provision of a slug formation interval;
6. Allowance for initial metal slug formation and movement prior to metal addition, slug acceleration (kinetic energy addition), slug heating (thermal energy addition) and slug shaping or sharpening by detonation burning in conical frustum main charge quantities 304 and 306;
7. Potential enhanced use of reflected shock wave energy in adding slug kinetic and thermal energy and slug sharpening effects from the detonation burning in conical frustum main charge quantities 304 and 306.

During operational detonation or detonation burning in the FIG. 3 cutter, (which again is shown in sectional view with detonator fuse at the centermost location) detonation pressures in the range of hundreds of Kilobars or millions of pounds per square inch are to be expected. At such pressures the physical strength of the preferred metallic copper of the FIG. 4 enclosing metal shell or jacket or sheath is negligible and a metal slug formed from the sheath behaves in the nature of a plasticized material, a material of little or no shear strength but of relatively high kinetic and thermal energy content.

Actually explosive cutter devices of the FIG. 2 and FIG. 3 type may be arranged to operate over a range of detonation-sourced energy conditions in order to achieve different types of cutting action. The high end of this operating range is associated with detonation pressures in the region of many hundreds of kilobars (several millions of pounds per square inch), copper metal liquefaction and liquid metal jet velocities of five to twelve millimeters per microsecond prior to impact with the object being cut. Operation in this range of energy levels is not necessary to achieve desirable cutting action in the present pipe cutting environment. Operation at lower energy levels is in fact more reliable and suited to field use and more economical in terms of material requirements and cutter component sizes and is therefore to be preferred in instances such as the present where it provides desirable cutting action.

For the present invention cutter, it is found desirable to operate the FIG. 3 apparatus in the pressure region of a few hundred kilobars (from several hundred thousand up to about three million pounds per square inch), achieve copper metal plasticizing rather than liquefaction and to reach plasticized metal slug velocities of three to four millimeters per microsecond prior to impact with the object being cut. In view of such lower energy operation in which the attainment of metal liquefaction is believed not to occur, the word "slug" is believed more appropriate than the word "jet" for the metal mass of the disclosed cutter and is used in the present document. The dimensions and explosive types and quantities disclosed in the present document are believed to achieve operation in this lower energy range.

The presently desired operation of the FIG. 3 cutter in this lower energy level range is not, however, deemed a limitation of the disclosed structure or of the invention. The FIG. 3 device is believed capable of improved cutting action when operated at the above-discussed higher levels of energy or at other energy levels. In this lower energy range it is also found that spalling of the cut pipe member at its outer surface opposite the internal surface area of metal slug impact comprises a portion of the achieved cutting action A detonator device for the FIG. 3 cutter is shown at 310 with the initial center-disposed detonation location being indicated at 308 and electrical lead wires for conduction of an initiating electrical current to the detonator 310 being indicated at 312. The path traversed by the plasticized metal slug in reaching the pipe 320 to be cut is indicated at 314 in the FIG. 3 drawing. The paths of the metal added to the initial slug during detonation of the explosive material conical frustum regions 304 and 306 are indicated generally at 316 and 318 respectively. The paths 316 and 318 are also believed to represent one path of the force wave resulting from detonation of the conical frustum regions 304 and 306 in reaching the metal slug for energy addition and sharpening purposes.

The FIG. 3 drawing also illustrates use of detonation containment end plate members 322 and 324 disposed generally parallel with the metal jet path 314. Such plates are believed to be an optional part of the FIG. 3 structure, a part which is not necessary for satisfactory cutter performance but possibly helpful under some use conditions. The metal plates 322 and 324 may be made of steel or other metals and may have thickness dimensions of between 0.1 and 0.25 inch for example. These metal plates 322 and 324 are believed to be helpful in, for example, increasing the effect of reflected shock wave energy on metal slug formation, acceleration, heating and sharpening.

The FIG. 3 cutter is preferably disposed within a liquid tight enclosure for disposition into the pipe 320 (and 106 in FIG. 1) being cut. Such an enclosure is represented generally at 326 in FIG. 3; the liquid environment into which such a cutter is often inserted is indicated at 327. This liquid environment may consist of fluids such as petroleum and water under conditions of pressure and temperature as discussed above herein and also include alkalinity or other chemical reactivity. Generally it is considered desirable for the cutter to be tolerant of these conditions for at least a short time interval, a time such as one hour being often specified. Explosive materials and other details for achieving this tolerance are discussed below herein. The pipe 320 being cut by the FIG. 3 cutter is usually fabricated from relatively high strength steel as also has been indicated above; for example, steel of the 4100 or 4340 types.

Actually the enclosure 326 is conveniently made in the form of cooperating parts which can be mated together at the use location of the cutter or elsewhere. Such parts may include, for example, the ceramic enclosure 328 and a mating metal coupling 330. The coupling 330 may be fitted with spacer bushings 332 and other parts as needed to provide a convenient and liquid impermeable structure, which is also adaptable to different cutter sizes and shapes. These additional parts may be arranged for threaded assembly or adhesive assembly or use other assembly techniques known in the art. Sealant materials such as Silicone rubber may also be used in assembling the FIG. 3 apparatus. A threaded insertion rod or pipe by which the FIG. 3 assembly may be inserted to subterranean levels in a well, as shown in FIG. 1, is represented at 334 in the FIG. 3 drawing.

The enclosure 326 in the FIG. 3 cutter assembly is preferably made of a zirconia ceramic: material and may in fact be similar in composition to the ceramic receptacle employed with currently used cutters of the FIG. 2 type. A significant feature of the ceramic enclosure 326 is the spherically shaped open space region 336 which surrounds the cutter 300. This open space region is desirably filled with air or some other low density, nonliquid and non-solid material in order to provide an open unobstructed region in which the cutting metal slug can be formed and acted upon during detonation burning of the explosive material. The open space region 336 can also have a cylindrical or other nonspherical shape if needed; however, there is believed to be some focusing and energy reflection benefit attending the illustrated spherical shape.

The presence of sidewall material at the region 338 of the ceramic enclosure 328 is considered to be somewhat detrimental to the formed metal slug in that it both requires expenditure of energy from the slug for its rupture and also tends to defocus or enlarge the formed slug. The slug performs the pipe cutting, during accomplishment of this rupture. The need for a clear and open area for slug formation (notwithstanding the high pressure hostile environment surrounding the FIG. 3 cutter) is nevertheless considered so significant as to obligate a tolerance of these detrimental effects of the ceramic material at 338. It is of course possible that a metal jacket, a plastic jacket or other enclosure arrangements can be successfully substituted for the ceramic enclosure 326 in other arrangements of the invention.

Figure 4:
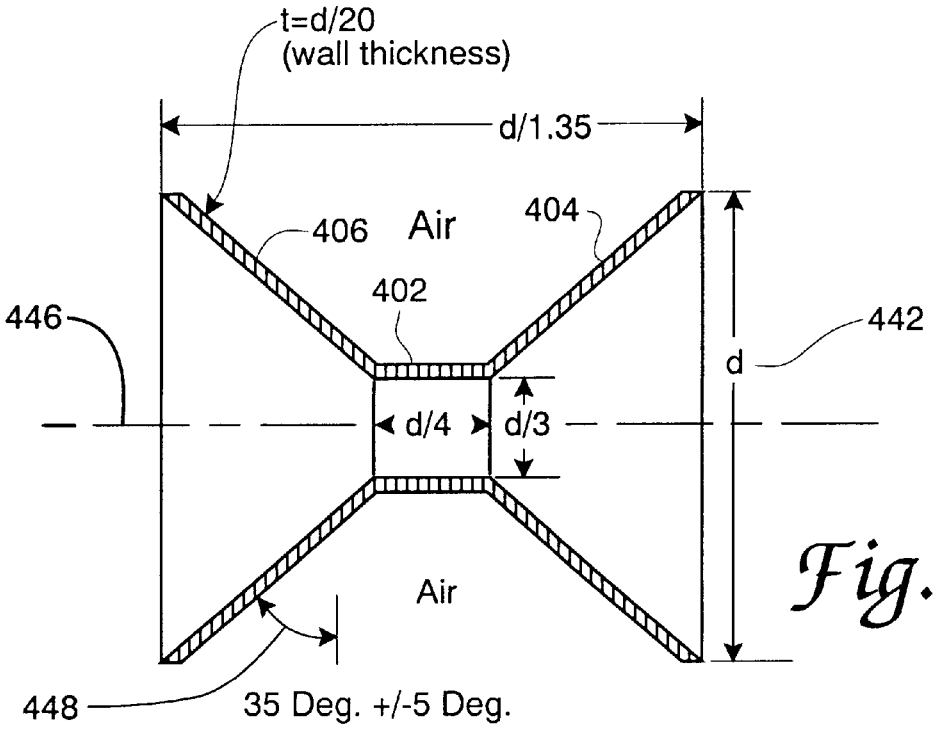
FIG. 4 shows a cutter according to the invention in cross section together with certain preferred interrelated dimensions.

In the operating sequence of the FIG. 3 cutter, it is believed that upon detonation initiation by detonator-igniter fuse 338, the centermost of the central cylindrical portion of the FIG. 4 sheath attains a plasticized metal state first. This event is believed to occur in the course of a few tens of microseconds following detonation initiation. The metal of this sheath central cylindrical portion therefore provides an initial part of the moving metal slug which performs the cutting action. Plasticization of the sheath metal of the remaining central cylindrical section and the conical frustum sections 304 and 306 metal occurs a few additional tens of microseconds propagation time after this first plasticization and the metal of these members adds to and falls in behind the initial plasticized metal as indicated at 316 and 318 in FIG. 3. The forces from detonation of the conical frustum explosive material masses are believed also to urge the metal of the slug into a thinner or effectively sharp layer which performs the cutting action. Shock wave and other transient wave phenomenon of course can add to or alter this operating sequence.

FIG. 4 in the drawings (which is also not drawn to scale) shows a metal sheath element for the FIG. 3 cutter 300 and also shows relative dimensional details of cutter 300 according to a scaling arrangement keyed on the largest overall diameter d, 442, of the cutter conical frustum regions 404 and 406. As indicated in FIG. 4, if this overall largest diameter 442 is d then the central cylindrical section 402 preferably has an internal diameter of d/3 and a length of d/4 and the enclosing metal shell or jacket or sheath preferably has a wall thickness of d/20. The horizontal or axial length of the cutter in FIG. 4 is preferably determined by the diameter d at 442 in view of the FIG. 4-disclosed 30 to 40 (35±5) degree angle 448 between conical frustum sidewalls and a radius orthogonal of the cutter central axis 446; this is in addition to the d/4 length at 402. For one size of the angle 448 within the indicated range, i.e. for an angle of about thirty six and four tenths degrees, the axial length of the overall cutter is also the d/1.35 dimension indicated at 450 in FIG. 4. The angle 448 is, as disclosed in the above identified issued parent patent application of the present application, considered a significant and somewhat selected detail of the cutter in order to achieve desirable operating characteristics. This angle is preferably made to be thirty five degrees plus or minus five degrees as shown in FIG. 4 or in other words an angle of between thirty and forty degrees.

As is suggested by use of the FIG. 4 cutter conical frustum diameter (d)-related dimensioning arrangement for the cutter of the present invention, it is possible to scale the dimensions of the cutter and the resulting quantity of the explosive and metal materials employed in order to accommodate the cutting of larger or smaller pipe sizes while keeping the resulting cutter within the selected energy range of operation. In the above identified issued parent patent of the present application such scaling is in fact disclosed to cover a range of "between 1 and 2, i.e., downward by a factor of ½ and upward by a factor of 2 while maintaining satisfactory performance".

For present invention purposes and as a result of further consideration of this scaling, it is now believed that this scaling can extend over the even larger range of between ¼ and 3; i.e., extend downward to a factor of ¼ and upward to a factor of 3. A set of actual typical pipe and cutter overall diameter-inclusive dimensions to which this scaling can be applied, i.e., dimensions based on the 2.88 inch outside diameter 105,000 pounds per square inch pressure rated pipe commonly used in the oil industry is shown at 338, 340, 342 and 344 in the FIG. 3 drawing. For the 2.88 inch pipe these FIG. 3 dimensions have numeric values of 2.03 inches for the cutter overall diameter at 338; 2.44 inches for the pipe inside diameter at 340; 3.42 inches for the pipe outside diameter at 342 and 0.21 inch for the pipe wall thickness at 344.

When the above recited scaling factors are applied to a cutter of 2.03 inch diameter the resulting cutter diameter range extends from 0.5 inch to about 6.1 inches for example. Such cutters are therefore usable for a significant range of pipe inside diameters.

When a scaling factor of 3 is applied to the 2.44 inch inside diameter pipe dimension shown at 340, for example, a pipe in excess of 7 inches in inside diameter is provided for; such a pipe could be encountered as a well casing, for example, in some uses of the invention. It is believed that additional work and possibly some modification of the scaling algorithm away from a direct numeric relationship for both cutter physical dimensions and explosive weight can extend this range of scaling to cover even smaller and larger sizes of pipe. Of course scaling is actually but a convenience consideration in use of the invention (and not a limitation of the invention) in that it can provide starting point estimates by which a new cutter configuration can be first approximated. Experience can often be used as a more accurate guide to dimensions and weights for each different cutter and pipe size. It is again not intended that this scaling limit the concept of the invention to the above seven inch pipe or any other pipe size since clearly the explosive configuration and other aspects of the invention can be extended to additional cutter sizes with some appropriate dimensions and explosive weights used in the cutter.

As a further aspect of these size and weight of explosive material considerations, the following Table 1 set of sizes and weights may be considered to provide cutters of satisfactory performance and also to indicate generally how sizes and weight are related in fabricating cutters according to the invention.

TABLE 1

| CUTTER SIZE, d | EXPLOSIVE QUANTITY | EMPTY CUTTER WEIGHT |
|---|---|---|
| 4.5 inch | 454 grams | 1002 grams |
| 1.65 inch | 27.7 grams | 60.9 grams |
| 1.24 inch | 10.3 grams | 26.9 grams |

In the above identified issued patent parent application of the present application the use of explosive materials of the type commonly used in military munitions and other performance driven applications of the cutter invention is disclosed. The large acceleration and deceleration forces experienced by a military projectile are also a significant consideration in selecting the explosive and related materials used in such a munitions application of the cutter invention since premature detonation from projectile launch and impact with a target structure could have such obviously undesirable consequences. In this parent application in fact it is stated that with respect to the projectile warhead "A typical insensitive explosive fill for the cylinder 11, the penetrator bomb casing, may contain the material known as AFX-644, a formulation that consists of 30% TNT, 40% NTO, 20% Aluminum and 10% wax." With respect to the explosive material used in the conical cutter of this parent application it is stated that "One suitable high performance explosive for the FIG. 4–FIG. 5 cutter is known as "Octol", another such explosive is known as "PBXN-110". Octol is made up of 75% HMX and 25% TNT; PBXN-110 is made up of 88% HMX and 12% inert binder."

Although it is believed that explosive materials of these types may be used successfully with the present pipe cutter arrangement, a more conservative and preferred approach is to use explosive formulations which are familiar and of known performance to persons working in the oil and other underground arts. Justification for this selection can also be based on the differing environment conditions encountered in each of these applications of the invention, including the high temperature conditions to be expected with the possible underground environment of the present invention. The explosive material known as PBX-9501, as is available from numerous suppliers including, for example, Ensign Bickford Industries Incorporated of Simsbury Conn., is to be preferred for use with the present invention cutter. This material is pressed with a high temperature resin binder and includes a high percentage of HMX explosive—a high performance explosive of British origin (i.e., Her Majesty's Explosive). The contents of the PBX-9501 material typically include 95% HMX and 5% binder (which is ½, or 2 ½%, Estane, and ½, or 2½%, BDNPA-F). This mix is understood to be pressed together without use of heat in forming the PBX-9501 material.

Notwithstanding the preferred arrangement for disposing a cutter according to the present invention within a pipe section to be cut, as is disclosed in the FIG. 3 drawing and discussed above, FIGS. 5, 6 and 7 of the drawings show an alternate and laboratory test suitable arrangement for use of the invention. Moreover, FIG. 7 of this group shows the actual results of a cutting test accomplished with the invention to the best degree a pipe test specimen documentary photograph can be represented in a two dimensional black and white drawing.

Figure 5:
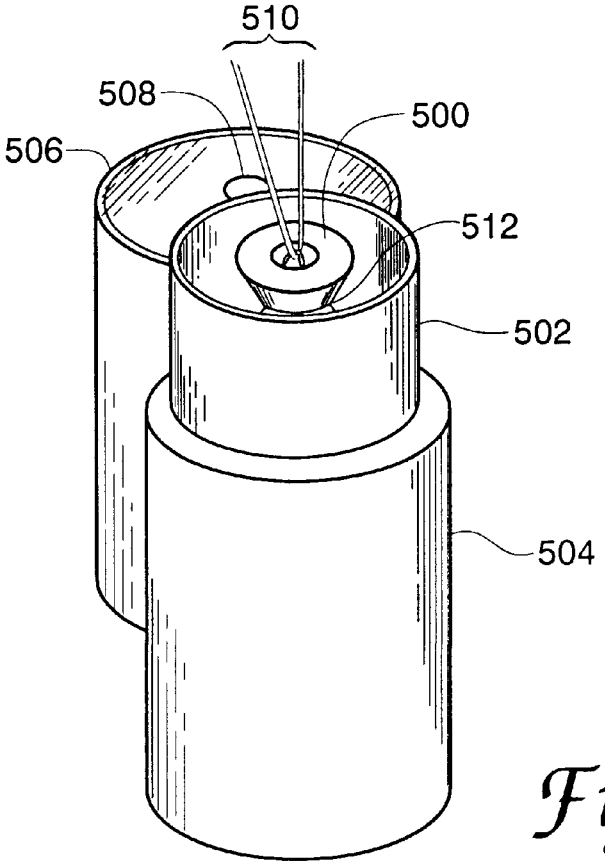
FIG. 5 shows a cutter according to the invention received in alternate and testing oriented surroundings opened for viewing.

FIG. 5 in this drawing group shows a laboratory arrangement of the invention, an arrangement in which plastic spacer members are used to position the cutter centrally within a test pipe. FIG. 5 accordingly shows the disposition of an explosive energy cutter according to the invention, 500, within a ceramic cylinder member 502 while one top plastic spacer member 506 is removed to show interior details. The cutter 500 and ceramic cylinder member 502 are disposed on a bottom spacer member 504 in the FIG. 5 drawing with each of the spacers 504 and 506 including a shallow recess area at its mating end in order to positively locate these parts. Detonator wiring is shown at 510 in the FIG. 5 cutter and an aperture for this wiring appears at 508 in the top spacer 500. The overall hourglass shape of the present invention cutter is represented at 512 in the FIG. 5 apparatus. In FIG. 6 of the drawings the cutter of FIG. 5 is shown in an assembled and ready for test configuration at 600 along with a sample 602 of the 2.88 inch outside diameter pipe to be cut. Insertion of the cutter 600 in the pipe 602 and supplying a current to the detonator leads initiates the test cutting. Notably the spherical space 336 is omitted from the FIG. 5 test arrangement of the invention. As noted in connection with FIG. 3, this spherical shape is considered an optional aspect of the invention and was not used in the FIG. 5 test apparatus.

Figure 7:
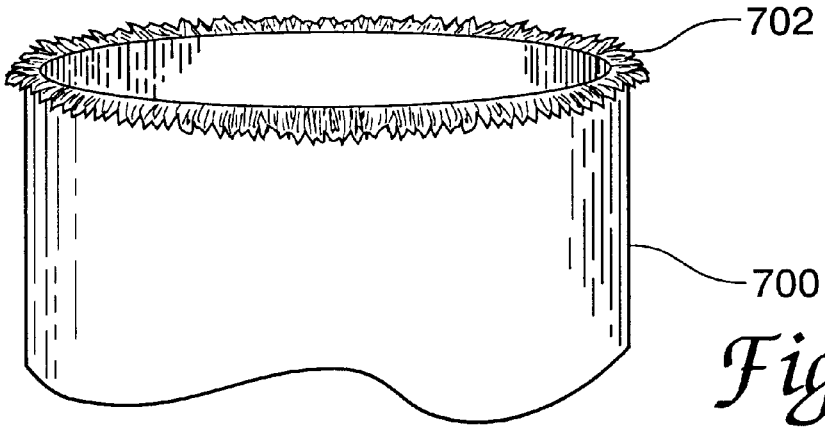
FIG. 7 shows one portion of the FIG. 6 test pipe following use of the FIG. 5 cutter.

FIG. 7 of the drawings shows the appearance of one-half of the pipe sample 602 to a different and larger scale after completion of the test cutting. Particularly notable aspects of the accomplished cutting include the following:

1. The melted or burred edge 702 of the pipe sample 602, 700 is relatively smooth and regular in appearance, i.e., is not appreciably rougher in the axial direction than a comparable saw cut.
2. The burred edge 702 is short in radial extent, approximately the radial dimension of the original pipe wall thickness.
3. The burred edge 702 is surprisingly thin in axial extent, i.e., the burr metal would be of little hindrance and easily broken away during axial movement of the cut pipe section as by a pipe removal operation.
4. There is zero spalling damage to the adjacent interior or exterior regions of the pipe 700 adjacent the cut edge.
5. There is no notable radial distortion of the pipe sample 700 as a result of the cut.
6. The cut is relatively thin in the axial direction; the cut measures about one quarter inch from peak to peak of the separated segments.

The cutting action achieved with the explosively formed penetrator device of the present invention when operated at the above described plasticized metal and hundreds of kilobars of pressure range of energy provides cutting action somewhat in accordance with a ratio of densities algorithm, an algorithm also described as a Bernoulli relationship. According to this algorithm, the depth of cut Cd achievable with a jet action cutter is in part predicted by:

$$C_d = k(d_1/d_2)^{1/2} l_p \quad (1)$$

where k is a constant of proportionality;

$d_1$ is the density of the cutter metal slug, (i.e., the density of copper or 8.9 in the preferred arrangement of the invention);

$d_2$ is the density of the material being cut (i.e., the density of steel or 7.8 in a typical use of the invention); and $l_p$ is the length of the annular radius of the slug, (i.e., the difference between the inside and outside radius of the annular slug).

Equation 1 most closely predicts the action of a jet action cutter, a cutter operating at a somewhat higher relative energy level than that of the present invention plasticized slug cutter. The equation is somewhat less accurate but nevertheless useful for a plasticized slug cutter. At the lower energy levels of the present plasticized slug cutter, this relationship is found in fact to err in the direction of over predicting the achieved art but is yet usable for at least first estimate cutting action predictions. The equation predicts effective cutter action for the disclosed materials combination of copper and steel where the ratios of the densities are favorable—as is supported by achieved experimental results.

Several variations of the disclosed cutter are considered viable options; these include, fcr example, change of the achieved cut from the FIG. 7 illustrated plane perpendicular to the pipe central axis to a more three dimensional ellipsoidal or other configuration, use of larger explosive material quantities to achieve cutting of greater wall thickness stock or multiple layers of stock, use of nonelectrically-initiated detonation, possible substitution of other metals or other materials for the copper metal, and limited shape and size variations of the cutter central cylindrical section.

It is understood that certain modifications to the invention as described may be made, as might occur to one with skill in the field of the invention, within the scope of the appended claims. Therefore, all embodiments contemplated hereunder, which achieve the objects of the present invention, have not been shown in complete detail. Other embodiments may be developed without departing from the scope of the appended claims.

What is claimed is:

1. Explosively formed penetrator apparatus for segregating an elongated tubular member section into axial segments, said apparatus comprising the combination of:

an hourglass-shaped explosive charge having an explosive energy-plasticizable conforming metal mass symmetrically disposed in lateral enclosure thereof;

said hourglass-shaped explosive charge and said conforming metal mass lateral enclosure each having a cylindrical center section terminated in conical frustum endmost sections of increasing diameter along a central axis thereof;

means for disposing said hourglass-shaped explosive charge and said explosive energy-plasticizable lateral enclosure metal mass internal of said elongated tubular member section at an axial position selected for segmentation; and means for detonating said explosive charge from a central portion of said cylindrical center section at a selected instant of time.

2. The explosively formed penetrator apparatus of claim 1 wherein said shaped explosive charge and said lateral enclosure metal mass conical frustum endmost sections of increasing diameter along a central axis of said elongated tubular member section each terminate in an explosive containment end plate member disposed orthogonal of said central axis at an axial extremity of said shaped explosive charge and said conforming metal mass lateral enclosure.

3. The explosively formed penetrator apparatus of claim 1 wherein said explosive energy-plasticizable conforming metal mass lateral enclosure comprises a second hourglass shape having a cylindrical center section terminated in conical frustum endmost sections of increasing diameter along a central axis of said cylindrical center section and said conforming metal mass second hourglass shape is disposed surrounding said hourglass-shaped explosive charge.

4. The explosively formed penetrator apparatus of claim 3 wherein said explosive energy-plasticizable hourglass shape metal mass is comprised of a metal having greater density than steel.

5. The explosively formed penetrator apparatus of claim 4 wherein said explosive energy-plasticizable hourglass shape metal mass is comprised of metallic copper.

6. The explosively formed penetrator apparatus of claim 3 wherein:

said explosive energy-plasticizable hourglass shape metal mass has an overall diameter of d measured orthogonally of said cylindrical center section central axis at each of said second hourglass conical frustum endmost sections;

said second hourglass shape metal mass cylindrical center section has an internal diameter of d/3 and a length of d/4.

7. The explosively formed penetrator apparatus of claim 6 wherein said second hourglass shape metal mass is configured as a metallic layer having a thickness of d/20.

8. The explosively formed penetrator apparatus of claim 1 wherein said hourglass conical frustum endmost sections of increasing diameter along a central axis of said cylindrical center section include central section-adjacent increasing diameter conical surfaces disposed at an angle of thirty-five degrees plus and minus five degrees with respect to a radial line orthogonal of said elongated tubular member section central axis.

9. The explosively formed penetrator apparatus of claim 3 wherein:

said explosive energy-plasticizable hourglass shape metal mass has an overall diameter of d measured orthogonally of said cylindrical center section central axis at each of said second hourglass conical frustum endmost sections;

said second hourglass shape metal mass cylindrical center section has an internal diameter of d/3 and a length of d/4;

said second hourglass shape metal mass is configured as a metallic layer having a thickness of d/20; and said hourglass conical frustum endmost sections of increasing diameter along a central axis of said cylindrical center section include central section-adjacent increasing diameter conical surfaces disposed at an angle of thirty-five degrees plus and minus five degrees with respect to a radial line orthogonal of said elongated tubular member section central axis.

10. The explosively formed penetrator apparatus of claim 1 wherein said means for detonating said explosive charge from a central portion of said cylindrical center section at a selected instant of time includes an electrical detonator apparatus centrally disposed in said hourglass cylindrical center section.

11. The explosively formed penetrator apparatus of claim 3 further including:

a protective enclosure member disposed surrounding said hourglass elements; and a plasticized metal slug-collection air space void received in said protective enclosure member surrounding said hourglass cylindrical center sections and portions of said conical frustum endmost sections.

12. An explosive material-energized internal method of cutting an elongated tubular cylinder into axially segregated segments, said method comprising the steps of:

disposing a conforming metal shell-surrounded hourglass-shaped explosive material mass having a central cylindrical hourglass stem portion, two joined conical frustum hourglass reservoirs and an hourglass-surrounding airspace region within said tubular cylinder at a selected axial cutting location thereof;

detonating said explosive material mass starting at an hourglass stem portion midpoint region to form, in said hourglass-surrounding airspace region, an initial plasticized metal slug from a portion of said conforming metal shell surrounding said hourglass;

receiving supplemental quantities of plasticized metal from midpoint-removed parts of said conforming metal shell surrounding said hourglass stem portion, and surrounding said hourglass reservoirs, into said initial plasticized metal slug as said detonation propagates away from said hourglass stem portion midpoint into hourglass reservoirs explosive material regions;

forming said supplemented metal slug into a thin planar sheet of increasing kinetic and thermal energy content with hourglass reservoir explosive material-sourced additional detonation energy until said hourglass reservoir detonations are completed; and impinging said thin planar sheet metal slug onto an interior surface portion and into successive wall-thickness-interior portions of said elongated tubular cylinder wall in execution of circumferential tubular cylinder cutting action and tubular cylinder segregation into axial segments as said hourglass reservoir detonations propagate to completion.

13. The explosive material-energized internal method of cutting an elongated tubular cylinder of claim 12 further including the steps of:

forming said hourglass-shaped explosive material-surrounding metal shell from copper metal; and filling said hourglass-shaped copper shell with explosive material.

14. The explosive material-energized internal method of cutting an elongated tubular cylinder of claim 12 further including the step of enclosing said conforming metal shell-surrounded hourglass-shaped explosive material mass within a closed nonmetallic member inclusive of said hourglass-surrounding airspace region prior to said step of disposing within said tubular cylinder at a selected axial cutting location.

15. The explosive material-energized internal method of cutting an elongated tubular cylinder of claim 14 further including the step of fabricating said closed nonmetallic member inclusive of said hourglass-surrounding airspace region of zirconia ceramic material having a spherical central void region comprising said airspace region.

16. The explosive material-energized internal method of cutting an elongated tubular cylinder of claim 12 further including the step of receiving reflected pressure wave energy from at least one of hourglass stem portion and hourglass reservoir portion-involved detonation as additional kinetic and thermal energy in said metal slug thin planar sheet.

17. Radially acting plasticized metal slug explosive energy cutter apparatus for separating an elongated cylindrical member into axially segregated cylindrical segments, said apparatus comprising the combination of:

an explosive material mass of overall hourglass shape disposed along a central axis of said elongated cylindrical member and having an axially disposed central cylindrical portion terminating in axially extending conical frustum portions of increasing radial diameter orthogonal of said central axis at opposed axial ends thereof;

a conformal enclosure member disposed surrounding lateral surface portions of said explosive material mass and having a mating hourglass shape which also includes an axially disposed central cylindrical portion terminating in axially extending conical frustum portions of increasing radial diameter along said central axis of said elongated cylindrical member;

said conformal enclosure member being comprised of a explosive detonation temperature and pressure-responsive plasticizable metal material;

a closed-end enclosure member received within said elongated cylindrical member surrounding lateral and an end portion of said conformal enclosure material surrounded explosive material mass;

a cutter apparatus positioning element received in said elongated cylindrical member adjacent a cutting location thereof; and an explosive material igniter fuse member centrally located within said hourglass shape central cylindrical portion of said explosive material mass.

18. The radially acting plasticized metal slug explosive energy cutter apparatus of claim 17 wherein said explosive material mass hourglass shape increasing radial diameter conical frustum portion defines an angle of thirty-five degrees plus and minus five degrees with respect to a radial from said central axis.

19. The radially acting plasticized metal slug explosive energy cutter apparatus of claim 17 wherein said explosive material is comprised of a high HMX high temperature explosive.

20. The radially acting plasticized metal slug explosive energy cutter apparatus of claim 17 wherein said explosive detonation temperature and pressure-liquefiable metal material is comprised of metallic copper.

21. The radially acting plasticized metal slug explosive energy cutter apparatus of claim 17 wherein said explosive material conformal enclosure member has a greatest diameter of d and angular surfaces of between thirty and forty degrees with respect to a plane perpendicular to said central axis and a length d/4 and a diameter of d/3 at said hourglass central portion.

22. The radially acting plasticized metal slug explosive energy cutter apparatus of claim 21 wherein said explosive material conformal enclosure member has a wall thickness of one twentieth of d and an overall length of d/ 1.35 along said central axis for one angle in said thirty to forty degree range.

23. The radially acting plasticized metal slug explosive energy cutter apparatus of claim 17 further including first and second explosive containment metallic plate members disposed at opposite axial ends of said explosive material and conformal enclosure member hourglass shapes.

24. The radially acting plasticized metal slug explosive energy cutter apparatus of claim 17 wherein said elongated cylindrical member comprises a pipe disposed in an underground location.

25. The method for improving cutting performance of a vee shaped explosive charge energized plasticized metal cutter comprising the steps of:

adding to an amount of explosive and plasticizable metal materials available for cutting action in said vee shaped explosive charge cutter by altering a cross sectional shape characteristic of said vee shaped explosive charge;

said cross sectional shape characteristic altering including adding at an axial center portion of said vee shaped explosive charge, intermediate explosive detonation-plasticizable metal covered explosive charge vee-half portions, an axially extending central cylindrical explosive charge section of smaller diameter than a largest diameter of said explosive charge vee-half portions;

said added axially extending central cylindrical explosive charge section being received in an axially extending central cylindrical enclosure of explosive detonation-plasticizable metal;

detonating said explosive material commencing at a central point of said added axially extending central cylindrical explosive charge section said detonation propagating thence along said axially extending central cylindrical section into said explosive charge vee-half portions.

26. The method for improving cutting performance of a vee shaped explosive charge energized plasticized metal cutter of claim 25 wherein said explosive detonation-plasticizable metal is copper.

27. The explosively formed penetrator apparatus of claim 3 wherein said air space void-received protective enclosure member disposed surrounding said hourglass elements is comprised of a zirconia ceramic material.

28. The explosively formed penetrator apparatus of claim 3 wherein said conforming metal mass lateral enclosure has an overall diameter within a range of one half to six and one tenth inches.

29. The explosive material-energized internal method of cutting an elongated tubular cylinder of claim 12 wherein said step of forming said supplemented metal slug into a thin planar sheet of increasing kinetic and thermal energy content includes accelerating said metal slug to a velocity between three and four millimeters per microsecond.

30. The explosive material-energized internal method of cutting an elongated tubular cylinder of claim 12 wherein said step of impinging said thin planar sheet metal slug onto an interior surface portion and into successive wall-thickness-interior portions of said elongated tubular cylinder wall further includes spalling away exterior surface portions of said elongated tubular cylinder wall.

31. The explosive material-energized internal method of cutting an elongated tubular cylinder of claim 12 wherein said step of impinging said thin planar sheet metal slug onto an interior surface portion and into successive wall-thickness-interior portions of said elongated tubular cylinder includes impacting said metal slug with said elongated tubular cylinder wall at subsonic velocity and generating a shock wave-induced spall region on an external surface portion of said elongated tubular cylinder.

* * * * *